US011326398B2

(12) United States Patent
Jin et al.

(10) Patent No.: US 11,326,398 B2
(45) Date of Patent: May 10, 2022

(54) PORTABLE SEAFLOOR DRILL RIG FOR SUBMERSIBLE FOR MULTI-POINT CORE DRILLING

(71) Applicant: HUNAN UNIVERSITY OF SCIENCE AND TECHNOLOGY, Hunan (CN)

(72) Inventors: Yongping Jin, Hunan (CN); Liang Liu, Hunan (CN); Youduo Peng, Hunan (CN); Buyan Wan, Hunan (CN); Jun Gong, Hunan (CN); Jian Yan, Hunan (CN)

(73) Assignee: HUNAN UNIVERSITY OF SCIENCE AND TECHNOLOGY, Xiangtan (CN)

( * ) Notice: Subject to any disclaimer, the term of this patent is extended or adjusted under 35 U.S.C. 154(b) by 0 days.

(21) Appl. No.: 17/153,578

(22) Filed: Jan. 20, 2021

(65) Prior Publication Data

US 2021/0254409 A1 Aug. 19, 2021

(30) Foreign Application Priority Data

Feb. 18, 2020 (CN) ..... 202010098494.7

(51) Int. Cl.
*E21B 7/12* (2006.01)
*E21B 4/00* (2006.01)
(Continued)

(52) U.S. Cl.
CPC ..... *E21B 7/12* (2013.01); *E21B 4/003* (2013.01); *E21B 4/006* (2013.01); *E21B 25/04* (2013.01);
(Continued)

(58) Field of Classification Search
CPC . E21B 4/003; E21B 4/006; E21B 7/12; E21B 7/124; E21B 10/02; E21B 17/0423; E21B 17/0426; E21B 25/04; E21B 25/18
See application file for complete search history.

(56) References Cited

U.S. PATENT DOCUMENTS 5,559,295 A * 9/1996 Sheryll ..... G01N 1/12 73/864.63
6,394,192 B1 * 5/2002 Frazer ..... E21B 7/124 175/58
2019/0368978 A1 * 12/2019 Sheryll ..... G01N 1/14

FOREIGN PATENT DOCUMENTS

CN 208950518 U 6/2019
CN 209261522 U 8/2019
(Continued)

*Primary Examiner* — Matthew R Buck

(57) ABSTRACT

The present disclosure provides a portable seafloor drill rig for a submersible for multi-point core drilling, including a power head, a reduction gear box, an emergency jettison device, a drilling tool, and a temperature and pressure-retaining device. a water supply connector and the power head are arrange on a top plate of the reduction gear box. An output shaft of the power head is connected to an input shaft of the reduction gear box, and an output shaft of the reduction gear box is provided with a central hole, which is in communication with a water inlet hole of the water supply connector. An output shaft of the reduction gear box is connected to the emergency jettison device, and the temperature and pressure-retaining device can perform temperature and pressure-retaining storage of the core drilled by the drilling tool.

12 Claims, 5 Drawing Sheets

(51) Int. Cl.

| | |
|---|---|
| ***E21B 25/04*** | (2006.01) |
| ***E21B 25/18*** | (2006.01) |
| *E21B 10/02* | (2006.01) |
| *E21B 17/042* | (2006.01) |

(52) U.S. Cl.
CPC ..... *E21B 25/18* (2013.01); *E21B 10/02* (2013.01); *E21B 17/0423* (2013.01); *E21B 17/0426* (2013.01)

(56) References Cited

FOREIGN PATENT DOCUMENTS

| | | | | |
|---|---|---|---|---|
| CN | 106368693 | B | | 9/2019 |
| CN | 110318666 | A | * | 10/2019 |

* cited by examiner

PORTABLE SEAFLOOR DRILL RIG FOR SUBMERSIBLE FOR MULTI-POINT CORE DRILLING

CROSS-REFERENCE TO RELATED APPLICATIONS

This application claims the benefit of priority from Chinese Patent Application No. 202010098494.7, filed on Feb. 18, 2020. The content of the aforementioned application, including any intervening amendments thereto, is incorporated herein by reference in its entirety.

TECHNICAL FIELD

The present application relates to a portable seafloor drill rig for a submersible for multi-point core drilling.

BACKGROUND

The use of drilling and sampling equipment to drill and sample the submarine solid mineral resources is a basis for analysis in composition and grade of ore bodies of the submarine solid mineral resources. The marine equipment such as the "Jiaolong" manned submersible, the "Deep-Sea Warrior" manned submersible, and unmanned submersible has been developed and widely used in the exploration of submarine resources, and the seafloor core sampling drill rigs for submersibles are developed to meet an urgent need of drilling for solid mineral resources, especially manganese nodules and cobalt-rich crusting on the surface of the seabed. Chinese Patent No. ZL200420036284.1 discloses a shallow-hole sampler for deep-sea manned submersibles, including a hydraulic drilling power head, an angle adjustment device for the drilling power head, a compensation and rod stabilization device, a sampler jettison device, and a drilling tool jettison device used in drill jamming accidents, which has a good working reliability, stability and safety. In addition, the jettison device can be used to jettison the sampler or its parts when a destructive failure such as a drill-jamming in the core-drilling occurs, to ensure that the submersible and the person can return safely. However, the sampler has disadvantages of complex overall structure, excessive actuators, excessive control points, and difficulty in control. Besides, the sampler must be fixedly arranged on the submersible, so the manned submersible must be controlled to approach the point to be cored before each coring operation of submarine solid mineral resource. The uneven distribution of submarine solid mineral resources on the seabed brings great safety concerns to the manned submersible when it is too close to the point to be cored. At the same time, the drilling angle can only be adjusted through the front and rear angle adjustment cylinders and the left and right swing cylinders, resulting in a small range of adjustable drilling angle ranges. Moreover, this patent does not provide a mechanism for coring repeatedly and retain the temperature and pressure of the core, and a temperature and pressure-retaining method. Chinese Patent No. ZL200420036287.5 discloses a multi-point core drill rig capable of automatically replacing a core inner tube in deep sea, includes a frame-type rack, an umbilical cable lifting device, an inner tube replacement mechanism for automatically replacing the core inner tube, a full hydraulic power, a body inclination adjustment mechanism, and a core-drilling mechanism. The drill rig can realize advantages of being able to change the inner tube multiple times to drill the core, adapt to the changes of the seabed terrain, work stably, and escape safely in a drill jamming accident. However, the disadvantages including a huge volume, a complicated structure, and its method for adjusting the inclination of the fuselage through the expansion and contraction of the rig legs on the bottom of the frame, make the drill rig unable to fully adapt to a complicated seabed terrain. Likewise, this patent does not provide a mechanism for retaining temperature and pressure of the core.

Currently, the submersibles in the prior art are equipped with operating manipulators to grasp the operating tools to carry out the drilling and sampling operations of the submarine solid mineral resources, which can not only effectively solve the safety concerns of the submersibles/Remotely Operated Vehicles (ROVs) that are too close to the point to be cored, but also achieves a flexible adjustment of different drilling angles using the flexibility of the operating manipulator. In order to overcome the shortcomings of the existing submersible shallow-hole sampler technology, prevent the pollution of the original rock core by the upper seawater during the ascent process, the death of mesophilic microorganisms and the high cost and low efficiency caused by a single core, and efficiently obtain high-quality original cores, it is urgent to develop a seafloor drill rig with a submersible operating manipulator, which has a simple structure and a convenient operation. In addition, it can flexibly adjust the drilling angle with the operating manipulator, and quickly jettison the drilling tool in an emergency situation.

SUMMARY

In order to solve the above-mentioned technical defects, the present disclosure provides a portable seafloor drill rig for a submersible for multi-point core drilling with a simple structure and a convenient operation, in which the drilling tool can be jettisoned in an emergency situation, thereby reducing failure cost.

The technical solution of the disclosure are described as follows.

The present disclosure provides a portable seafloor drill rig for a submersible for multi-point core drilling, comprising:

a power head, a reduction gear box, an emergency jettison device, a drilling tool, and a temperature and pressure-retaining device;

wherein a water supply connector and the power head are arrange on a top plate of the reduction gear box; an output shaft of the power head is connected to an input shaft of the reduction gear box; an output shaft of the reduction gear box is provided with a central hole, and the central hole is in communication with a water inlet hole of the water supply connector;

the emergency jettison device comprises:

a shell;

a fixing ring;

a main spindle;

a jettisonable shaft piston; and a steel ball ferrule;

wherein the shell is arranged on the reduction gear box; the main spindle, having a tubular structure, is arranged in the shell via a bearing; a lower end of an output shaft of the reduction gear box is connected to an upper end of an inner hole of the main spindle via a key; a lower end of the inner hole of the main spindle is connected to an upper end of a jettisonable connecting shaft of the drilling tool via a key;

a lower end of the main spindle is provided with a plurality of steel ball holes located in the same horizontal plane; each of the steel ball holes is provided with a steel ball; the steel ball ferrule and the fixing ring are sleeved outside the main spindle; the steel ball ferrule is set corresponding to the steel ball hole; a lower part of an inner hole of the steel ball ferrule is wedge-shaped, so as to squeeze the steel balls toward a center of the main spindle; the fixing ring is arranged above the steel ball ferrule; the jettisonable connecting shaft is provided with a boss corresponding to the plurality of steel ball holes; an upper and lower ends of the boss are spherical, and a middle part of the boss is cylindrical; the plurality of steel balls support the boss of the jettisonable connecting shaft; the jettisonable shaft piston sleeve is sleeved outside the steel ball ferrule and the fixing ring; an inner hole of the jettisonable shaft piston is provided with two stepped surfaces; an upper end of the steel ball ferrule and an upper end of the fixing ring are respectively provided with a washer; the washers of the steel ball ferrule and the fixing ring respectively support the two stepped surfaces of the inner hole of the jettisonable shaft piston;

a retaining ring is arranged in the inner hole of the jettisonable shaft piston, and located at the upper end of the fixing ring; an upper-middle part of an outer ring of the jettisonable shaft piston is matched with an inner hole of the shell; a diameter of both ends of the outer ring of the jettisonable shaft piston is smaller than that of a middle part of the outer ring of the jettisonable shaft piston; two ends of the outer ring of the jettisonable shaft piston and the inner hole of the shell respectively enclose two oil cavities, and each of the two oil cavities is respectively in communication with two oil inlets on the shell; and the temperature and pressure-retaining device is configured to retain a temperature and a pressure of a rock core drilled by the drilling tool.

In an embodiment, the drilling tool comprises:

a jettisonable connecting shaft, a drill pipe, and a petal structure;

wherein the jettisonable connecting shaft is provided with an external thread; the jettisonable connecting shaft is screwed with the temperature and pressure-retaining device through the external thread; a lower end of the jettisonable connecting shaft is connected to the drill pipe; a bottom of the drill pipe is a diamond ring bit; the petal structure is fixed inside the drill pipe; the jettisonable connecting shaft is provided with a tachometric transducer; and a pressure valve is arranged at an inner hole of the jettisonable connecting shaft.

In an embodiment, the pressure valve comprises:

a valve core, a water supply press rod, a spring, and a fixing ring for the pressure valve;

wherein the jettisonable connecting shaft is provided with a valve core hole and a press rod hole; the valve core hole and the press rod hole are arranged along an axial direction of the jettisonable connecting shaft; the valve core hole is in communication with the press rod hole; the valve core and the fixing ring for the pressure valve are providede in the valve core hole; the spring is arranged between the valve core and the fixing ring for the pressure valve; the valve core is capable of blocking the press rod hole; and the valve core is connected to the water supply press rod, which extends from the press rod hole.

In an embodiment, a filter screen is welded to the bottom of the jettisonable connecting shaft; an axis of the filter hole is parallel to an axis of the jettisonable connecting shaft; and a diameter of a filter hole is smaller than that of the water supply press rod.

In an embodiment, the portable seafloor drill rig further comprises: a first pressure compensator;

wherein the first pressure compensator is fixedly arranged on a side wall of the reduction gear box; the first pressure compensator comprises a first pressure compensation cylinder, an end cover, a first piston and a spring; a lower end of the first pressure compensation cylinder is configured as an opening; the opening at the lower end of the first pressure compensation cylinder is provided with the end cover; a seawater inlet is provided on a side wall at the lower end of the first pressure compensation cylinder; the first piston is provided in the first pressure compensation cylinder; the piston and the end cover are connected via the spring; a top of the first pressure compensation cylinder is provided with two pressure compensation valves, wherein a pressure compensation valve is connected to an oil inlet pipe with a check valve, and the other pressure compensation valve is connected to an end of an oil outlet pipe; a top plate of the reduction gear box is provided with a pressure compensation valve; and the other end of the oil outlet pipe is connected to the pressure compensation valve on the reduction gear box.

In an embodiment, a pillar is provided on a top surface of the end cover, and the spring of the first pressure compensator is sleeved on the pillar.

In an embodiment, the portable seafloor drill rig further comprises a handle;

wherein the handle is fixedly arranged on a side wall of the reduction gear box.

In an embodiment, the shell of the emergency jettison device comprises a jettisonable shaft cylinder and a lower cover; the jettisonable shaft cylinder has a tubular structure, and a lower part of an inner hole of the jettisonable shaft cylinder has a larger diameter than an upper part; a lower part of the jettisonable shaft cylinder is provided with a piston sleeve; a seal ring is provided between the piston sleeve and the inner hole of the jettisonable shaft cylinder; an upper and lower ends of the jettisonable shaft cylinder are respectively provided with a connecting flange; the upper end of the jettisonable shaft cylinder is connected to a bottom plate of the reduction gear box via bolts; a first sealing gasket is provided between the connecting flange at the upper end of the jettisonable shaft cylinder and the bottom plate of the reduction gear box; the lower cover is connected to the connecting flange at the lower end of the jettisonable shaft cylinder via bolts; a second sealing gasket is provided between the lower cover and the connecting flange at the lower end of the jettisonable shaft cylinder; a central hole for the jettisonable connecting shaft to pass through is provided at a center of the lower cover; and an oil seal is arranged between the central hole of the lower cover and the jettisonable connecting shaft.

In an embodiment, the temperature and pressure-retaining device comprises an insulating cylinder and a second pressure compensator; the insulating cylinder is provided with a stepped central hole; a seal ring is arranged on a step surface of the stepped central hole, and a top of an inner hole of the insulating cylinder is provided with an internal thread for connecting to an external thread of the jettisonable connecting shaft; an insulating layer is provided at an inner wall of the insulating cylinder; after completing a core drilling, the drilling tool is screwed with the insulating cylinder through the external thread on a washer of the jettisonable connecting shaft so that the drill pipe is stored in the insulating cylinder; the second pressure compensator comprises a second pressure compensation cylinder, a second piston, a compensator end cover and an inflation valve; one end of the pressure compensation cylinder is configured as an opening, and the other end is connected to a bottom of the central hole of the insulating cylinder through a high-pressure pipe; the compensator end cover is fixed at the opening of the pressure compensation cylinder; the compensator end cover is provided with a connecting hole communicating with the inflation valve; the second piston is arranged in the pressure compensation cylinder, and the second piston and an inner cavity of the second pressure compensation cylinder are sealed by a seal ring.

In an embodiment, the portable seafloor drill rig further comprises a rock rack; wherein the rock rack comprises an upper plate, a lower plate and a plurality of vertical pillars; the upper plate and the lower plate are arranged in parallel; the upper plate and the lower plate are fixedly connected by the plurality of vertical pillars; the upper plate is provided with a plurality sets of through holes; each set of through holes comprises two interconnected through holes; the lower plate is arranged with a plurality sets of blind holes with the same position and size as the plurality sets of through holes on the upper plate, and each set of blind holes comprises two interconnected blind holes; the insulating cylinders and the second pressure compensators of the plurality sets of temperature and pressure-retaining devices are grouped to pass through the plurality sets of through holes on the upper plate and fixed in the plurality sets of blind holes in the lower plate.

In an embodiment, a water inlet hole at a top of the water supply connector is provided with a water inlet port for connecting a water inlet pipe.

In an embodiment, a steel ball hole is provided on a side wall of the main spindle; the steel ball hole is a variable diameter through hole; an inner end of the steel ball hole is tapered or spherical; and a diameter of the steel ball hole through the side wall of an inner hole of the main spindle is smaller than that of the steel ball.

Compared to the prior art, the present invention has following beneficial effects.

The portable seafloor drill rig for a submersible for multi-point core drilling of the present invention has a simple and compact structure, a small volume and high reliability, which can transmit large torque, held by a mechanical hand, and realize a multi-point coring and emergency jettison of drilling tools. Moreover, it ensures the safety of the submersible and reduces the cost of failure maintenance. The core drill rig of the present invention is mainly composed of a power head, a reduction gear box, an emergency jettison device, a drilling tool and a temperature and pressure-retaining device, thereby greatly reducing the size of the drill rig; the drill rig can be held by a submersible manipulator to perform core drilling in multi-angle according to changes in seabed topography, and retracted in the designated position when it is not in operation. The power head of the drill rig is driven by hydraulic pressure to meet the core drilling of different hardness rocks. Various functions such as seafloor coring and drilling can be realized by changing different drill bits. The rock rack is provided to realize multi-point coring by the drill rig; the cores taken are stored in an insulating cylinder, and the pressure is compensated by the second pressure compensator, thereby realizing a temperature and pressure-retaining storage function of the cores taken; when a drill jamming occurs, the drilling tool can be jettisoned through the emergency jettison device to ensure the safety of the submersible.

1, handle; 2, driven gear; 3, reduction gear box; 4, lower cover of reduction gear box; 5, main spindle; 6, fixing ring; 7, jettisonable shaft piston; 8, steel ball ferrule; 9, pressure valve; 901, water supply press rod, 902, valve core; 903, fixing ring of pressure valve; 10, piston sleeve; 11, jettisonable shaft cylinder; 12, drill pipe; 13, water inlet pipe; 14, water inlet port; 15, driven gear shaft; 16, water supply connector; 17, power head; 18, connecting sleeve; 19, output shaft of power head; 20, driving gear shaft; 21, piston; 22, pillar; 23, spring; 24, oil inlet pipe; 25, oil inlet; 26, steel ball; 27, lower cover; 28, tachometric transducer; 29, jettisonable connecting shaft; 30, seal ring; 31, bearing; 32, key; 33, gasket; 34, retaining ring; 35, oil seal; 36, petal structure; 37, mesh plate; 38, oil outlet pipe; 39, check valve; 40, pressure compensation valve; 41, pressure compensation cylinder; 42, seawater inlet; 43, end cover; 44, insulating cylinder; 45, inflation valve; 46, high pressure pipe; 47, upper plate; and 48, lower plate.

DETAILED DESCRIPTION OF EMBODIMENTS

The present disclosure will be further described in detail in conjunction with the accompanying drawings.

Figure 1:
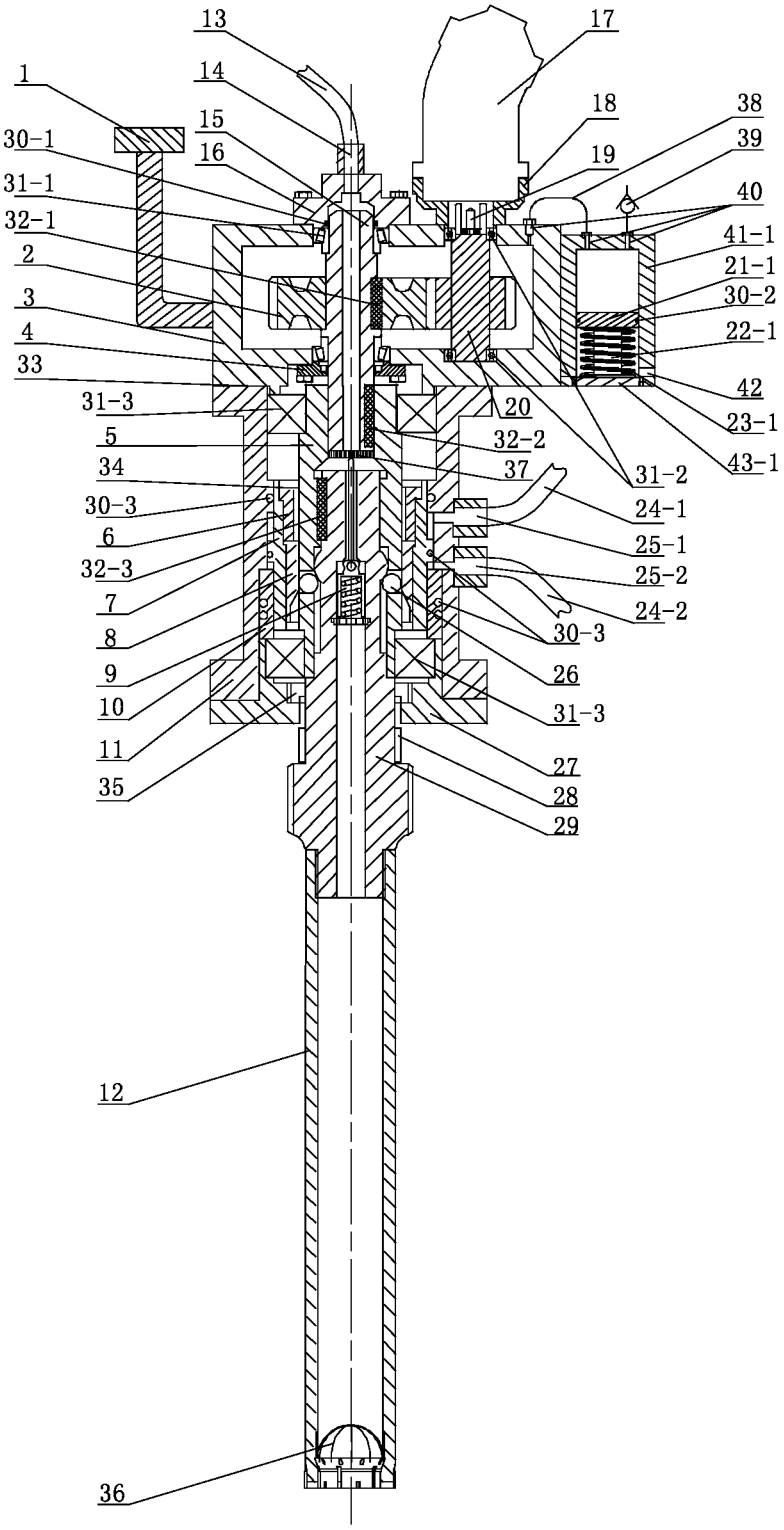
FIG. 1 is a schematic diagram of a portable seafloor drill rig for a submersible for multi-point core drilling according to the present disclosure.

As shown in FIG. 1, a portable seafloor drill rig for a submersible for multi-point core drilling of the present disclosure includes a handle 1, a power head 17, a reduction gear box 3, an emergency jettison device, a drilling tool, a temperature and pressure-retaining device and a rock rack. The handle 1 is fixed on a side wall of the reduction gear box 3 for the manipulator to hold the core drill rig of the present disclosure. A water supply connector 16 and a connecting sleeve 18 are arrange on a top plate of the reduction gear box 3. A gasket is arranged between the top plate of the reduction gear box 3 and the water supply connector 16, and a water inlet port 14 is provided on the water supply connector 16, which is used to connect to a water inlet pipe 13. The power head 17 is arranged on the connecting sleeve 18, and an output shaft 19 of the power head 17 is connected to the driving gear shaft 20 (an input shaft of the reduction gear box 3). The upper and lower ends of the driving gear shaft 20 are respectively arranged on a top plate and a bottom plate of the reduction gear box 3 through bearings 31-2. The connecting sleeve 18 is fixed on the top plate of the reduction gear box 3 by bolts, and the driving gear shaft 20 is located inside the reduction gear box 3, The driving gear shaft 20 is provided with a driving gear. Two ends of the driven gear shaft 15 (an output shaft of the reduction gear box 3) are respectively arranged on the top plate and the bottom plate of the reduction gear box 3 through bearings 31-1. The driven gear shaft 15 is parallel to the driving gear shaft 20. The driven gear shaft 15 is provided with a driven gear 2, and the driving gear meshes with the driven gear 2. The driven gear shaft 15 is provided with a central hole, which is in communication with the water inlet hole of the water supply connector 16. An upper part of the driven gear shaft 15 and the water supply connector 16 are sealed by a seal ring 30-1.

The emergency jettison device includes a shell; a fixing ring 6; a main spindle 5; a jettisonable shaft piston 7; a piston sleeve 10 and a steel ball ferrule 8. The shell of the emergency jettison device includes a jettisonable shaft cylinder 11 and a lower cover 27. The jettisonable shaft cylinder 11 has a tubular structure. The upper and lower ends of the jettisonable shaft cylinder 11 are respectively provided with a connecting flange. The upper end of the jettisonable shaft cylinder 11 is connected to the bottom plate of the reduction gear box 3 by bolts, and a gasket 31 is provided between the connecting flange on the jettisonable shaft cylinder 11 and the bottom plate of the reduction gear box 3. The lower cover 27 is connected to the connecting flange at the lower end of the abandoned shaft cylinder 11. A gasket is provided between the lower cover 27 and the connecting flange at the lower end of the jettisonable shaft cylinder 11. A center part of the lower cover is provided with a central hole for the jettisonable connecting shaft 29 to pass through. An oil seal 35 is provided between the jettisonable connecting shafts 29. A diameter of the lower part of the inner hole of the jettisonable shaft cylinder 11 is larger than that of the upper part. The lower part of the inner hole of the jettisonable shaft cylinder 11 is provided with a piston sleeve 10, and a seal ring 30-3 is provided between the piston sleeve 10 and the inner hole of the jettisonable shaft cylinder 11. The main spindle 5, having a tubular structure, is arranged in a jettisonable shaft cylinder via a bearing 31-3. The lower end of the driven gear shaft 15 and the upper end of the inner hole of the main spindle 5 are connected via a key 32-2. The lower end of the inner hole of the main spindle 5 is connected to the upper end of the jettisonable connecting shaft 29 through a key 32-3. A mesh plate is fixedly connected to a bottom plate of the main spindle 5. A lower part of the main spindle 5 is provided with eight steel ball holes, where the eight steel ball holes are located in the same horizontal plane, and each steel ball hole is respectively provided with a steel ball 26. Each steel ball hole is a variable diameter through hole; the inner end of each steel ball hole is tapered or spherical; and the diameter of each steel ball hole through the side wall of the inner hole of the main spindle 5 is smaller than the diameter of the steel ball 26.

Figure 2:
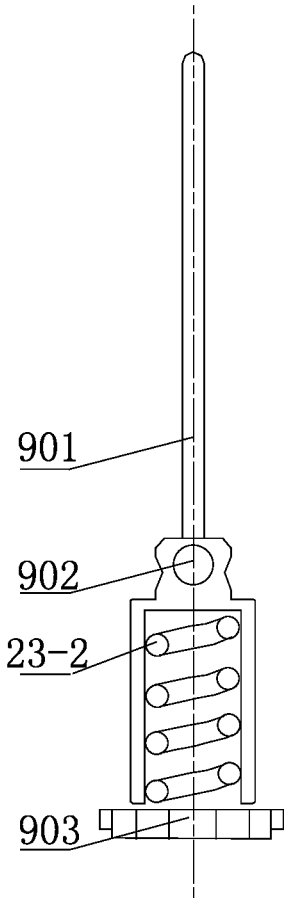
FIG. 2 is a schematic diagram of a pressure valve according to the present disclosure.
Figure 3:
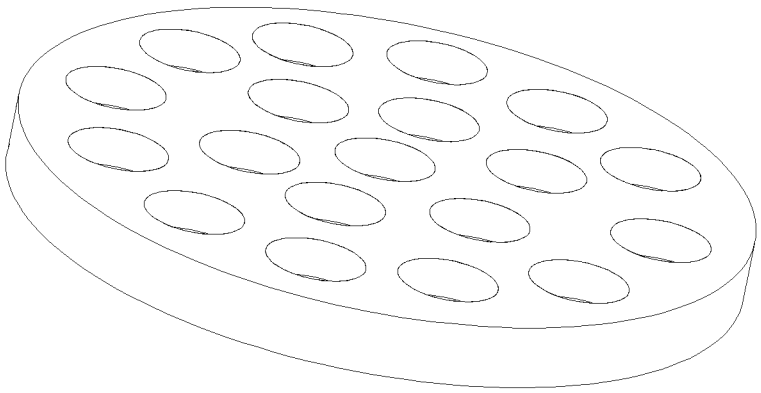
FIG. 3 is a schematic diagram of a mesh plate according to the present disclosure.

The steel ball ferrule 8 and the fixing ring 6 are sleeved on an outside of the main spindle 5. The steel ball ferrule 8 is set corresponding to the steel ball hole. A lower part of the inner hole of the steel ball ferrule 8 is wedge-shaped, so as to squeeze the steel ball 26 toward a center of the spindle 5. The fixing ring 6 is located above the steel ball ferrule 8; the jettisonable connecting shaft 29 is provided with a boss corresponding to each steel ball hole. The upper and lower ends of the boss are spherical, and a middle part is cylindrical. A plurality of steel balls 26 can support the boss of the jettisonable connecting shaft 29. The jettisonable shaft piston 7 is sleeved on the outside of the steel ball ferrule 8 and the fixing ring 6. The inner hole of the jettisonable shaft piston 7 is provided with two stepped surfaces. Therefore, the steel ball ferrule 8 and the fixing ring 6 can move up and down with the abandoning piston 7, and the upward movement of the steel ball ferrule 8 can realize a removal of the steel ball 26 when the jettisonable connecting shaft 29 is inserted. A retaining ring 32 is provided in the inner hole of the jettisonable shaft piston 7, and located at an upper end of the fixing ring 6. An upper middle part of an outer ring of the jettisonable shaft piston 7 is matched with the inner hole of the shell, and the diameter of both ends of the outer ring of the jettisonable shaft piston 7 is smaller than that of the middle diameter. The two ends of the outer ring of the jettisonable shaft piston 7 and the inner hole of the shell respectively enclose two oil cavities, where the two oil cavities are connected to the two oil inlets 25-1 and 25-2 on the shell respectively, and the two oil inlets 25-1 and 25-2 are respectively connected to the oil inlet pipes 24-1, 24-2. The oil is injected from the oil inlet 25-1, and returned at the oil inlet 25-2 to realize an upward movement of the jettisonable shaft piston 7. Oppositely, the oil is injected from the oil inlet 25-2, and returned at the oil inlet 25-1 to realize a downward movement of the jettisonable shaft piston 7. The drilling tool includes a jettisonable connecting shaft 29, a drill pipe 12 and a petal structure 36. A flange of the jettisonable connecting shaft 29 is provided with an external thread. The jettisonable connecting shaft 29 can be screwed to an insulating cylinder 44 of the temperature and pressure-retaining device through external threads on the flange. A lower end of the jettisonable connecting shaft 29 is connected to the drill pipe, and the bottom of the drill pipe 12 is a diamond ring drill bit. The petal structure 36 is fixed inside the drill pipe 12. A tachometric transducer 28 is sheathed in a middle of the jettisonable connecting shaft 29. A pressure valve 9 is arranged in the inner hole of the jettisonable connecting shaft 29. As shown in FIG. 2, the pressure valve 9 includes a valve core 902, a water supply press rod 901, a spring 23-2 and a fixing ring 903 for the pressure valve. The jettisonable connecting shaft 29 is further provided with a valve core hole and a press rod hole, where the valve core hole and the press rod hole are arranged along an axial direction of the jettisonable connecting shaft 29. The valve core hole is connected to the press rod hole, and the valve core 902 and the fixing ring 903 for the pressure valve are provided in the valve core hole. A spring 23-2 is arranged between the valve core 902 and the fixing ring 903 for the pressure valve. The valve core 902 can block the press rod hole. The valve core 902 is connected to the water supply press rod 901. The water supply press rod 901 extends from the press rod hole. An upper end of the water press rod 901 can be in contact with the mesh plate 37. The mesh plate 37 is evenly arranged with holes of equal size, the diameter of which is smaller than the diameter of the water press rod 901.

The first pressure compensator is fixedly arranged on a side wall of the reduction gear box; the first pressure compensator includes a pressure compensation cylinder 41-1, an end cover 43-1, a piston 21-1 and a spring 23-1. A lower end of the pressure compensation cylinder 41-1 is configured as an opening. The end cover 43-1 is provided at the opening at the lower end of the pressure compensation cylinder 41-1. A seawater inlet 42 is provided on a side wall at the lower end of the pressure compensation cylinder 41-1. The piston 21-1 is provided in the pressure compensation cylinder 41-1. The piston 21-1 and the end cover 43-1 are connected by the spring 23-1. A pillar 22-1 is provided on a top surface of the end cover 43-1, and the spring 23-1 is sleeved on the pillar 22-1. A top of the pressure compensation cylinder 41-1 is provided with two pressure compensation valves 40, one pressure compensation valve is connected to the oil inlet pipe with a check valve 39, and the other pressure compensation valve is connected to one end of the oil outlet pipe 38. A pressure compensation valve 40 is provided on a top plate of the reduction gear box 3, and the other end of the oil outlet pipe 38 is connected to the pressure compensation valve 40 on the reduction gear box 3.

Figure 4:
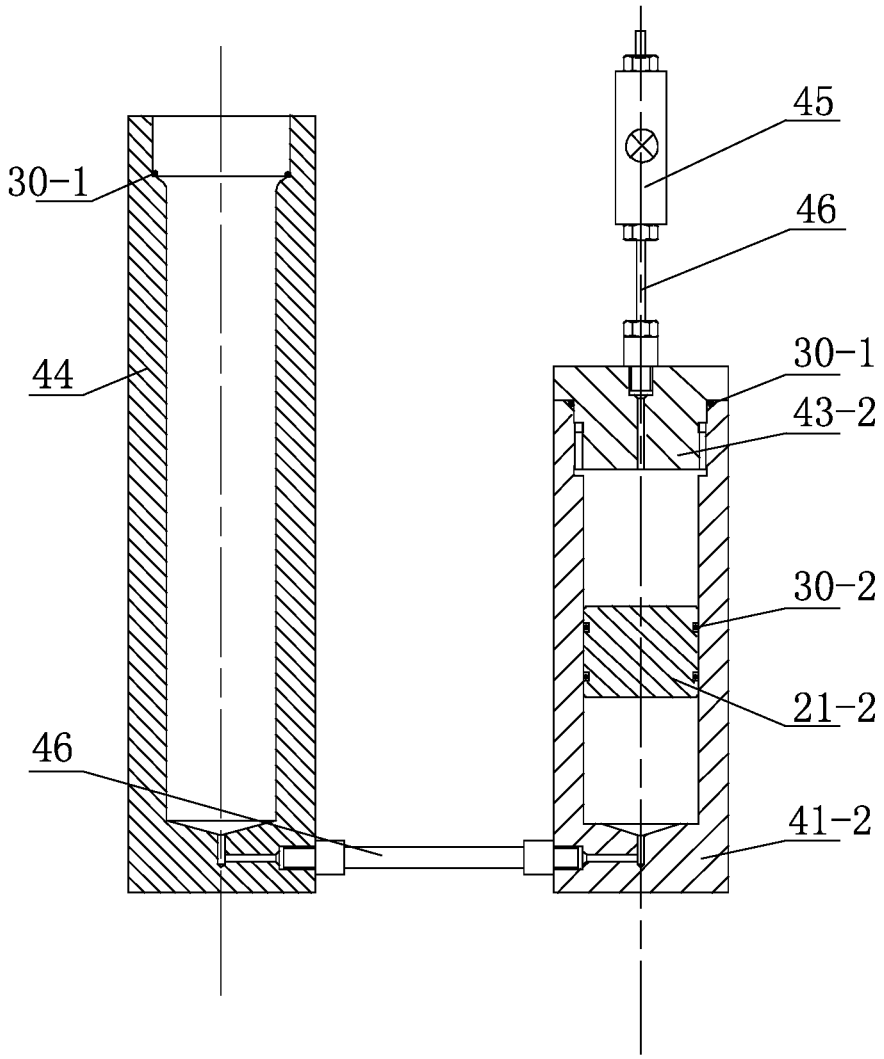
FIG. 4 is a schematic diagram of a temperature and pressure-retaining device according to the present disclosure.

As shown in FIG. 4, the temperature and pressure-retaining device includes an insulating cylinder 44 and a second pressure compensator. The insulating cylinder 44 is a stepped central hole. A seal ring 30-1 is arranged on a step surface of the stepped central hole. A top of an inner hole of the insulating cylinder 44 is provided with an internal thread for connecting to an external thread of the flange of the jettisonable connecting shaft 29. The inner wall of the insulating cylinder 44 is provided with a heat preservation layer. After completing a core drilling, the drilling tool is screwed with the insulating cylinder through the external thread on the flange of the jettisonable connecting shaft 29 so that the drill pipe 12 is stored in the insulating cylinder 44. The second pressure compensator comprises a second pressure compensation cylinder 41-2, a piston 21-2, a compensator end cover 43-2 and an inflation valve 45. One end of the pressure compensation cylinder 41-2 is configured as an opening, and the other end is connected to a bottom of the central hole of the insulating cylinder 44 through a high-pressure pipe 46. The compensator end cover 43-2 is fixed at the opening of the pressure compensation cylinder 41-2. The compensator end cover 43-2 is provided with a connecting hole communicating with the inflation valve 45. The piston 21-2 is arranged in the pressure compensation cylinder 41-2, and the piston 21-2 and an inner cavity of the second pressure compensation cylinder 41-2 are sealed by a seal ring 30-2.

Figure 5:
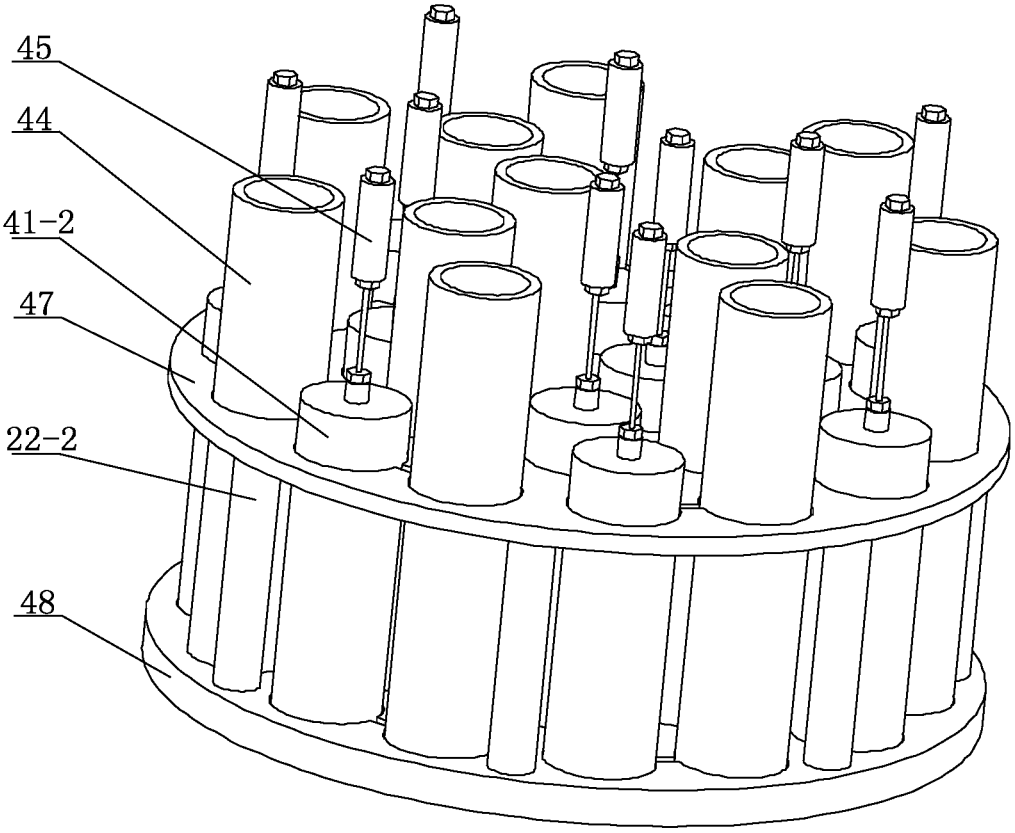
FIG. 5 is a perspective view showing temperature and pressure-retaining device being arranged on a rock rack according to the present disclosure.

As shown in FIG. 5, the rock rack includes an upper plate 47, a lower plate 48 and a plurality of vertical pillars 22-2. The upper plate 47 and the lower plate 48 are arranged in parallel. The upper plate 47 and the lower plate 48 are fixedly connected by the plurality of vertical pillars 22-2. The upper plate 47 is provided with a plurality sets of through holes. Each set of through holes comprises two interconnected through holes. The bottom plate 48 is arranged with a plurality sets of blind holes with the same position and size as the plurality sets of through holes on the upper plate 47, and each set of blind holes comprises two interconnected blind holes. The insulating cylinders 44 and the second pressure compensators of the plurality sets of temperature and pressure-retaining device are grouped to pass through the plurality sets of through holes on the upper plate 47 and fixed in the plurality sets of blind holes in the lower plate 48.

An operation process of the portable seafloor drill rig of the present disclosure is as follows.

1. Before running the core drill rig of the present disclosure into water, the insulating cylinders 44 and the second pressure compensators of the plurality of temperature and pressure-retaining devices into are first grouped to pass through a set of interconnected through holes of the upper plate 47 of the rock rack, and the insulating cylinder 44 and the bottom of the second pressure compensator is placed into a set of interconnected blind holes in the lower plate 48, so that the insulating cylinder 44 and the second pressure compensator are stably installed in the rock rack. Then, the plurality of drilling tools are respectively screwed to the plurality sets of insulating cylinders 44 through external threads on the flange of the jettisonable connecting shaft 29. Finally, a cavity between a top of the pressure compensation cylinder 41-1 of the first pressure compensator and the piston 21-1 is pre-filled with oil through the check valve 39, and a cavity between the top of the pressure compensation cylinder 41-2 and the piston 21-2 of the second pressure compensator of the temperature and pressure-retaining device is pre-filled with nitrogen with 0.3 times the water depth pressure of the subsea sampling point through the inflation valve 45.

2. A drilling tool is unscrewed from one of the thermal insulating cylinders 44 on the rock rack, and an upper end of the jettisonable connecting shaft 29 of the drilling tool is inserted into a lower end of the inner hole of the main spindle 5. The jettisonable connecting shaft 29 of the drilling tool is fastened to the lower end of the inner hole of the main spindle 5 through the cooperation of the steel ball ferrule 8, the fixing ring 6, and the plurality of steel balls 26. At the same time, the water supply press rod 901 of the pressure valve 9 moves downward under the pressure of the net plate 37, so that the pressure valve 9 is in an open state.

3. When the portable seafloor drill rig of the present disclosure dives from the sea surface with the submersible to a designated seafloor sampling point, the seawater enters the first pressure compensator through the seawater inlet 42 under an action of external pressure, and pushes the piston 21-1 up, so that the oil in the first pressure compensator enters the reduction gear box 3, thereby ensuring a pressure balance between the reduction gear box 3 and the seawater.

4. After the submersible reaches the designated seafloor sampling point, a manipulator on the submersible clamps the handle 1 of the core drill rig of the present disclosure to adjust to the designated position. The main spindle 5 is driven to rotate by the power head 17 through the reduction gear box 3, so as to drive the jettisonable connecting shaft 29 of the drilling tool and the drill pipe 12 below to rotate. The submersible manipulator is controlled to complete the controls of the drilling direction and angle of the core drill rig of the present disclosure. The flushing liquid is transported through the water inlet pipe 13, the driven gear shaft 15 and the jettisonable connecting shaft 29 to flush the borehole. The jettisonable connecting shaft 29 and the main spindle 5 are not only connected by the key 32-3 to transmitted torque, but also axially fixed by the steel ball 26 to transmit axial force. An annular jettisonable shaft piston component composed of the jettisonable shaft piston 7, the fixing ring 6, the steel ball ferrule 8, and the retaining ring 34 can move synchronously in the up and down direction, but due to the gap between the components, the rotation of the main spindle 5 is not transmitted to the annular jettisonable piston 7. When the annular jettisonable shaft piston component is in the position as shown in FIG. 1, the eight steel balls 26 are respectively restricted by the steel ball ferrules 8 inside the eight through holes on the main spindle 5, and a part of the sphere is convex from the inner wall of the main spindle 5 and just against the beveled steps of the jettisonable connecting shaft 29 inserted into the main spindle 5, so that the jettisonable connecting shaft 29 is fixed in the main spindle 5, and the axial pulling force can be transmitted to the drill rod, which is connected to the jettisonable connecting shaft. With the overall downward movement of the drill rig, the drilling tool goes deep into the seabed rock formation to get the core.

If a drill jamming occurs during a core drilling process, the emergency jettisonable device is first controlled to inject oil from the oil inlet 25-2 to force the jettisonable shaft piston 7 to move upwards, and drive the steel ball ferrule 8 to move upwards to move the steel ball 26 out, so that the fastened jettisonable connecting shaft 29 is released, and the main spindle 5 is separated from the jettisonable connecting shaft 29, thereby completing a jettison of the drilling tool.

5. After the core drilling process is completed, the manipulator on the submersible is first manipulated to lift the core drill rig as a whole, and at the same time take out the obtained core. Then, the manipulator on the submersible is manipulated to carry the core drill rig to a top of the insulating cylinder 44 on the rock rack from which the drilling tool has been taken out, and the drilling tool from which the core is taken is screwed to the insulating cylinder 44 from which the drilling tool has been taken out through the external threads on the flange of the jettisonable connecting shaft 29 so that the drill pipe 12 is stored in the insulating cylinder 44. When the jettisonable connecting shaft 29 and the insulating cylinder 44 are screwed together, the oil is injected through the oil inlet 25-2, to force the jettisonable shaft piston 7 to move upwards, and drive the steel ball ferrule 8 to move upwards to move the steel ball 26 outwards, so the jettisonable connecting shaft 29 is released, and the main spindle 5 is separated from the jettisonable connecting shaft 29, thereby completing a single core drilling process.

Figure 6:
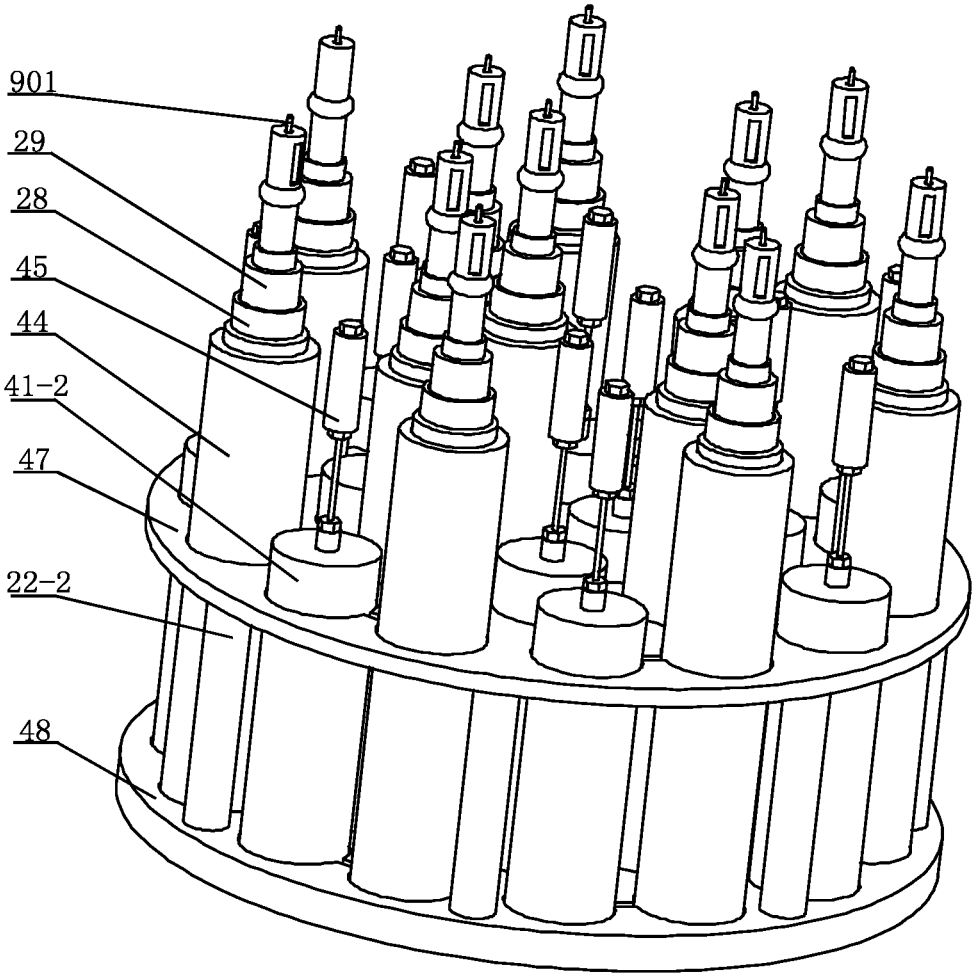
FIG. 6 is a perspective view showing a rock rack being filled with drilling tools after coring according to the present disclosure.

6. The other manipulator on the submersible is controlled to unscrew an idle drilling tool from the other insulating cylinder 44 on the rock rack, and steps 2-5 are repeated until all the idle drilling tools have completed the seafloor core drilling, and respectively screwed to the insulating cylinder 44 on the rock rack (as shown in FIG. 6, the rock rack is filled with drilling tools after core drilling), thereby completing a multi-point core drilling of the hard rock core on the seafloor surface.

What is claimed is:

1. A portable seafloor drill rig for a submersible for multi-point core drilling, comprising:

a power head, a reduction gear box, an emergency jettison device, a drilling tool, and a temperature and pressure-retaining device;

wherein a water supply connector and the power head are arrange on a top plate of the reduction gear box; an output shaft of the power head is connected to an input shaft of the reduction gear box; an output shaft of the reduction gear box is provided with a central hole, and the central hole is in communication with a water inlet hole of the water supply connector;

the emergency jettison device comprises:

a shell;

a fixing ring;

a main spindle;

a jettisonable shaft piston; and a steel ball ferrule;

wherein the shell is arranged on the reduction gear box; the main spindle, having a tubular structure, is arranged in the shell via a bearing; a lower end of the output shaft of the reduction gear box is connected to an upper end of an inner hole of the main spindle via a key; a lower end of the inner hole of the main spindle is connected to an upper end of a jettisonable connecting shaft of the drilling tool via a key;

a lower end of the main spindle is provided with a plurality of steel ball holes located in the same horizontal plane; each of the steel ball holes is provided with a steel ball; the steel ball ferrule and the fixing ring are sleeved outside the main spindle; the steel ball ferrule is set corresponding to the steel ball hole; a lower part of an inner hole of the steel ball ferrule is wedge-shaped, so as to squeeze the steel balls toward a center of the main spindle; the fixing ring is arranged above the steel ball ferrule; the jettisonable connecting shaft is provided with a boss corresponding to the plurality of steel ball holes; an upper end and a lower end of the boss are spherical, and a middle part of the boss is cylindrical; the plurality of steel balls support the boss of the jettisonable connecting shaft; the jettisonable shaft piston is sleeved outside the steel ball ferrule and the fixing ring; an inner hole of the jettisonable shaft piston is provided with two stepped surfaces; an upper end of the steel ball ferrule and an upper end of the fixing ring are respectively provided with a washer; the washers of the steel ball ferrule and the fixing ring respectively support the two stepped surfaces of the inner hole of the jettisonable shaft piston;

a retaining ring is arranged in the inner hole of the jettisonable shaft piston, and located at the upper end of the fixing ring; an upper-middle part of an outer ring of the jettisonable shaft piston is matched with an inner hole of the shell; a diameter of both ends of the outer ring of the jettisonable shaft piston is smaller than that of a middle part of the outer ring of the jettisonable shaft piston; two ends of the outer ring of the jettisonable shaft piston and the inner hole of the shell respectively enclose two oil cavities, and each of the two oil cavities is respectively in communication with two oil inlets on the shell; and the temperature and pressure-retaining device is configured to retain a temperature and a pressure of a rock core drilled by the drilling tool.

2. The portable seafloor drill rig of claim 1, wherein the drilling tool comprises:

the jettisonable connecting shaft, a drill pipe, and a petal structure;

wherein the jettisonable connecting shaft is provided with an external thread; the jettisonable connecting shaft is screwed with the temperature and pressure-retaining device through the external thread; a lower end of the jettisonable connecting shaft is connected to the drill pipe; a bottom of the drill pipe is a diamond ring bit; the petal structure is fixed inside the drill pipe; the jettisonable connecting shaft is provided with a tachometric transducer; and a pressure valve is arranged at an inner hole of the jettisonable connecting shaft.

3. The portable seafloor drill rig of claim 2, wherein the pressure valve comprises:

a valve core, a water supply press rod, a spring, and a fixing ring for the pressure valve;

wherein the jettisonable connecting shaft is provided with a valve core hole and a press rod hole; the valve core hole and the press rod hole are arranged along an axial direction of the jettisonable connecting shaft; the valve core hole is in communication with the press rod hole; the valve core and the fixing ring for the pressure valve are provided in the valve core hole; the spring is provided between the valve core and the fixing ring for the pressure valve; the valve core is capable of blocking the press rod hole; and the valve core is connected to the water supply press rod, which extends from the press rod hole.

4. The portable seafloor drill rig of claim 1, wherein a filter screen is welded to the bottom of the jettisonable connecting shaft; an axis of a filter hole is parallel to an axis of the jettisonable connecting shaft; and a diameter of the filter hole is smaller than that of a water supply press rod.

5. The portable seafloor drill rig of claim 1, further comprising: a first pressure compensator;

wherein the first pressure compensator is fixedly arranged on a side wall of the reduction gear box; the first pressure compensator comprises a first pressure compensation cylinder, an end cover, a first piston and a spring; a lower end of the first pressure compensation cylinder is configured as an opening; the opening at the lower end of the first pressure compensation cylinder is provided with the end cover; a seawater inlet is provided on a side wall at the lower end of the first pressure compensation cylinder; the first piston is provided in the first pressure compensation cylinder; the piston and the end cover are connected via the spring; a top of the first pressure compensation cylinder is provided with two pressure compensation valves, wherein a pressure compensation valve is connected to an oil inlet pipe with a check valve, and the other pressure compensation valve is connected to an end of an oil outlet pipe; the top plate of the reduction gear box is provided with a pressure compensation valve; and the other end of the oil outlet pipe is connected to the pressure compensation valve on the reduction gear box.

6. The portable seafloor drill rig of claim 5, wherein a pillar is provided on a top surface of the end cover, and the spring is sleeved on the pillar.

7. The portable seafloor drill rig of claim 1, further comprising: a handle;

wherein the handle is fixedly arranged on a side wall of the reduction gear box.

8. The portable seafloor drill rig of claim 1, wherein the shell of the emergency jettison device comprises a jettisonable shaft cylinder and a lower cover; the jettisonable shaft cylinder has a tubular structure, and a lower part of an inner hole of the jettisonable shaft cylinder has a larger diameter than an upper part; a lower part of the jettisonable shaft cylinder is provided with a piston sleeve; a seal ring is provided between the piston sleeve and the inner hole of the jettisonable shaft cylinder; an upper end and a lower end of the jettisonable shaft cylinder are respectively provided with a connecting flange; the upper end of the jettisonable shaft cylinder is connected to a bottom plate of the reduction gear box via bolts; a first sealing gasket is provided between the connecting flange at the upper end of the jettisonable shaft cylinder and the bottom plate of the reduction gear box; the lower cover is connected to the connecting flange at the lower end of the jettisonable shaft cylinder via bolts; a second sealing gasket is provided between the lower cover and the connecting flange at the lower end of the jettisonable shaft cylinder; a central hole for the jettisonable connecting shaft to pass through is provided at a center of the lower cover; and an oil seal is arranged between the central hole of the lower cover and the jettisonable connecting shaft.

9. The portable seafloor drill rig of claim 2, wherein the temperature and pressure-retaining device comprises an insulating cylinder and a second pressure compensator; the insulating cylinder is provided with a stepped central hole; a seal ring is arranged on a step surface of the stepped central hole, and a top of an inner hole of the insulating cylinder is provided with an internal thread for connecting to an external thread of the jettisonable connecting shaft; an insulating layer is provided at an inner wall of the insulating cylinder; after completing a core drilling, the drilling tool is screwed with the insulating cylinder through the external thread on a washer of the jettisonable connecting shaft so that the drill pipe is stored in the insulating cylinder; the second pressure compensator comprises a second pressure compensation cylinder, a second piston, a compensator end cover and an inflation valve; one end of the pressure compensation cylinder is configured as an opening, and the other end is connected to a bottom of the central hole of the insulating cylinder through a high-pressure pipe; the compensator end cover is fixed at the opening of the pressure compensation cylinder; the compensator end cover is provided with a connecting hole communicating with the inflation valve; the second piston is arranged in the pressure compensation cylinder, and the second piston and an inner cavity of the second pressure compensation cylinder are sealed by a seal ring.

10. The portable seafloor drill rig of claim 1, further comprising a rock rack; wherein the rock rack comprises an upper plate, a lower plate and a plurality of vertical pillars; the upper plate and the lower plate are arranged in parallel; the upper plate and the lower plate are fixedly connected by the plurality of vertical pillars; the upper plate is provided with a plurality sets of through holes; each set of through holes comprises two interconnected through holes; the lower plate is arranged with a plurality sets of blind holes with the same position and size as the plurality sets of through holes on the upper plate, and each set of blind holes comprises two interconnected blind holes; the insulating cylinders and the second pressure compensators of the plurality sets of temperature and pressure-retaining devices are grouped to pass through the plurality sets of through holes on the upper plate and fixed in the plurality sets of blind holes in the lower plate.

11. The portable seafloor drill rig of claim 1, wherein the water inlet hole at a top of the water supply connector is provided with a water inlet port for connecting a water inlet pipe.

12. The portable seafloor drill rig of claim 1, wherein a steel ball hole is provided on a side wall of the main spindle; the steel ball hole is a variable diameter through hole; an inner end of the steel ball hole is tapered or spherical; and a diameter of the steel ball hole through the side wall of an inner hole of the main spindle is smaller than that of the steel ball.

* * * * *